US006949714B2

(12) United States Patent
Kontani et al.

(10) Patent No.: US 6,949,714 B2
(45) Date of Patent: Sep. 27, 2005

(54) SWITCH APPARATUS

(75) Inventors: Masaki Kontani, Tsuruga (JP); Takeshi Fujii, Tsuruga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 39 days.

(21) Appl. No.: 10/970,308

(22) Filed: Oct. 21, 2004

(65) Prior Publication Data

US 2005/0150755 A1 Jul. 14, 2005

(30) Foreign Application Priority Data

Jan. 8, 2004 (JP) ..... 2004-002720

(51) Int. Cl.[7] ..... H01H 13/14
(52) U.S. Cl. ..... 200/520; 200/345
(58) Field of Search ..... 200/520, 521, 200/341–345, 5 R, 5 A

(56) References Cited

U.S. PATENT DOCUMENTS 5,545,865 A * 8/1996 Gotou ..... 200/341
5,710,397 A * 1/1998 Liao ..... 200/5 A
5,715,932 A * 2/1998 Motoyama et al. ..... 200/521
5,921,381 A * 7/1999 Von Arx ..... 200/345
6,310,308 B1 * 10/2001 Watson et al. ..... 200/520
6,590,176 B2 * 7/2003 Cole et al. ..... 200/341
6,765,164 B2 * 7/2004 Lee et al. ..... 200/345

FOREIGN PATENT DOCUMENTS

JP 2001-283673 10/2001

* cited by examiner

*Primary Examiner*—K. Lee
(74) *Attorney, Agent, or Firm*—RatnerPrestia

(57) ABSTRACT

A switch apparatus has a case that includes a hollow projecting support section, a switch contact provided inside the case, and a button having a depressing section that comes into contact with the switch contact and mounted on the support section in a manner vertically movable. Furthermore, an inwardly projecting catch section is provided on the inner periphery of the support section, and an engaging hole is provided on the depressing section of the button into which the catch section is to be inserted. In this configuration, an opening on the top surface of the case is not required when manufacturing the case and the button by resin molding. As a result, a switch apparatus is obtained which is superior in resistance to water and dust and stable in operation.

4 Claims, 5 Drawing Sheets

SWITCH APPARATUS

BACKGROUND OF THE INVENTION

1. Field of the Invention

The present invention relates to switch apparatuses primarily for use in the operation of an air conditioner, audio equipment and the like installed in automobiles.

2. Background Art

In recent years, a switch apparatus in which buttons are arranged is generally installed on the front panel of a cabin for control of various electronic equipment such as air conditioner and audio equipment. A description of such conventional switch apparatus is given referring to FIG. 5 to FIG. 7.

FIG. 5 is a sectional view of a conventional switch apparatus. FIG. 6 is an exploded perspective view of the conventional switch apparatus. Supporting sections 1A that are hollow and cylindrical and project upwardly are provided on case 1 made of an insulating resin and claw-like catch sections 1B are provided on the four exterior sides of supporting sections 1A. Engaging hole 2A is provided on each of the four sides of button 2 made of an insulating resin. Catch section 1B is inserted into engaging hole 2A and button 2 is mounted in a manner vertically movable relative to supporting section 1A.

Conductive patterns (not drawn) are formed on the top and bottom surfaces of wiring board 3, and push switches 4 are mounted on the top surface, thereby switch contacts are configured. Depressing section 2B that projects downward is provided on the bottom of button 2 and the bottom end thereof comes into contact with push switch 4. A switch apparatus is configured by covering push switch 4 and the top surface of wiring board 3 with cover 1.

In the above configuration, when button 2 on the right, for example, is depressed as shown in FIG. 7, button 2 moves downward and depressing section 2B depresses push switch 4 on the right. With this, electrical on-off action is performed inside switch 4. When the depressing force on button 2 is released, button 2 returns to the state as shown in FIG. 5 by the returning force of push switch 4.

In a switch apparatus as configured in this way, claw-like catch sections 1B are provided on the exterior surfaces of support section 1A in order to mount button 2 on case 1 and prevent it from falling. When forming such a partially projecting catch section 1B using an upper and a lower dies, a pin (not drawn) that extends down to the bottom end of catch section 1B along the exterior surface of support section 1A is required. Accordingly, when forming case 1 with dies, opening 1C having approximately the same width as that of catch section 1B is formed near the foot of support section 1A on the top surface of case 1 through which the pin pierced.

Alternatively, catch section 1B may also be formed by providing a slide pin on a die that can move in all directions relative to the four exterior sides of support section 1A when forming case 1. In this case, the die structure is complicated and fabrication is difficult when support sections 1A project upward of case 1 as described above and their spacing is small.

Such a switch apparatus is disclosed in Japanese Patent Application Unexamined Publication No. 2001-28367, for example.

In the conventional switch apparatus as described above, opening 1C is formed on the foot of support section 1A on the top surface of case 1. Accordingly, when installing it in a cabin of an automobile for operating an air conditioner and audio equipment, water and dust tend to enter into the switch apparatus through opening 1C and may cause trouble in switching operation.

SUMMARY OF THE INVENTION

The switch apparatus of this invention has a case that includes a hollow support section projecting upward, a switch contact provided inside the case, and a button having a depressing section that comes into contact with the switch contact and mounted on the support section in a manner vertically movable. Furthermore, an inwardly projecting catch section is provided in the inner periphery of the support section of the case and an engaging hole into which the catch section is to be inserted is provided on the depressing section of the button. In this configuration, it is not necessary to provide an opening on the top surface of the case when manufacturing the case and the button by resin molding. Accordingly, a switch apparatus is obtainable which is superior in resistance to water and dust, and stable in operation.

DETAILED DESCRIPTION OF THE INVENTION

Figure 1:
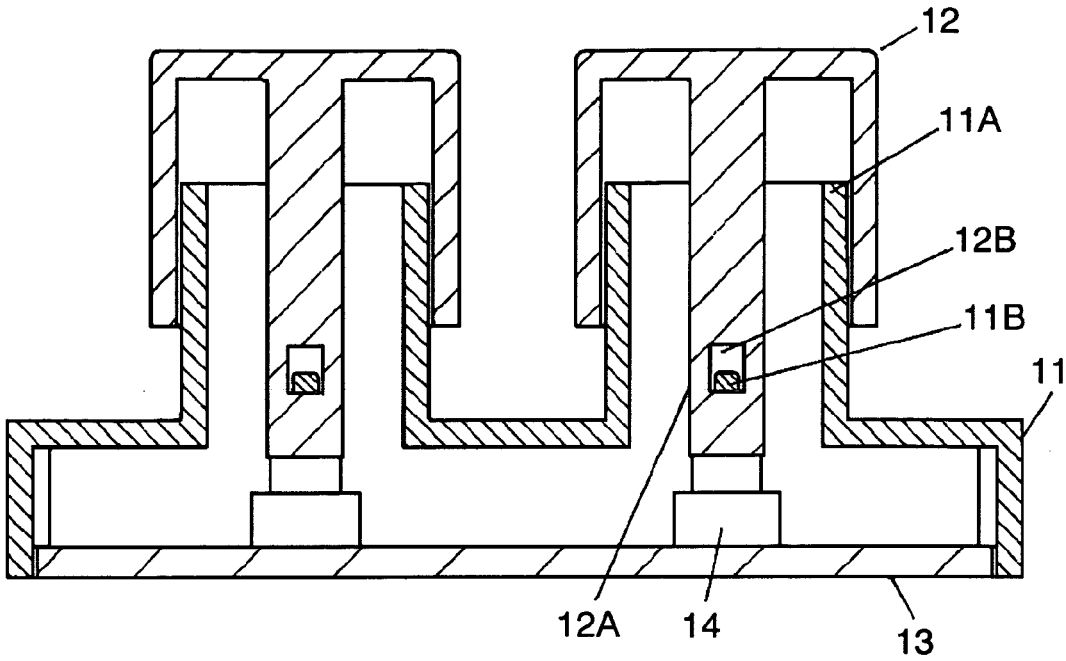
FIG. 1 is a sectional view of a switch apparatus in an embodiment of the present invention.
Figure 2:
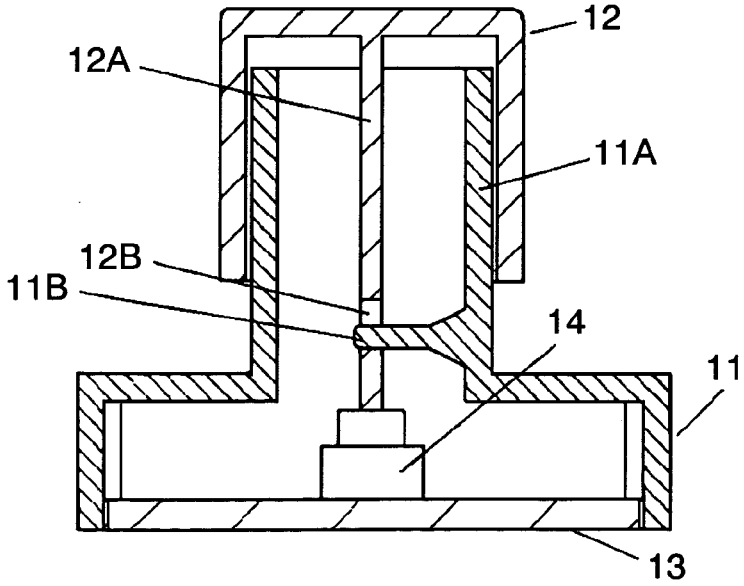
FIG. 2 is a sectional view of the switch apparatus of FIG. 1 as taken from a different direction.
Figure 3:
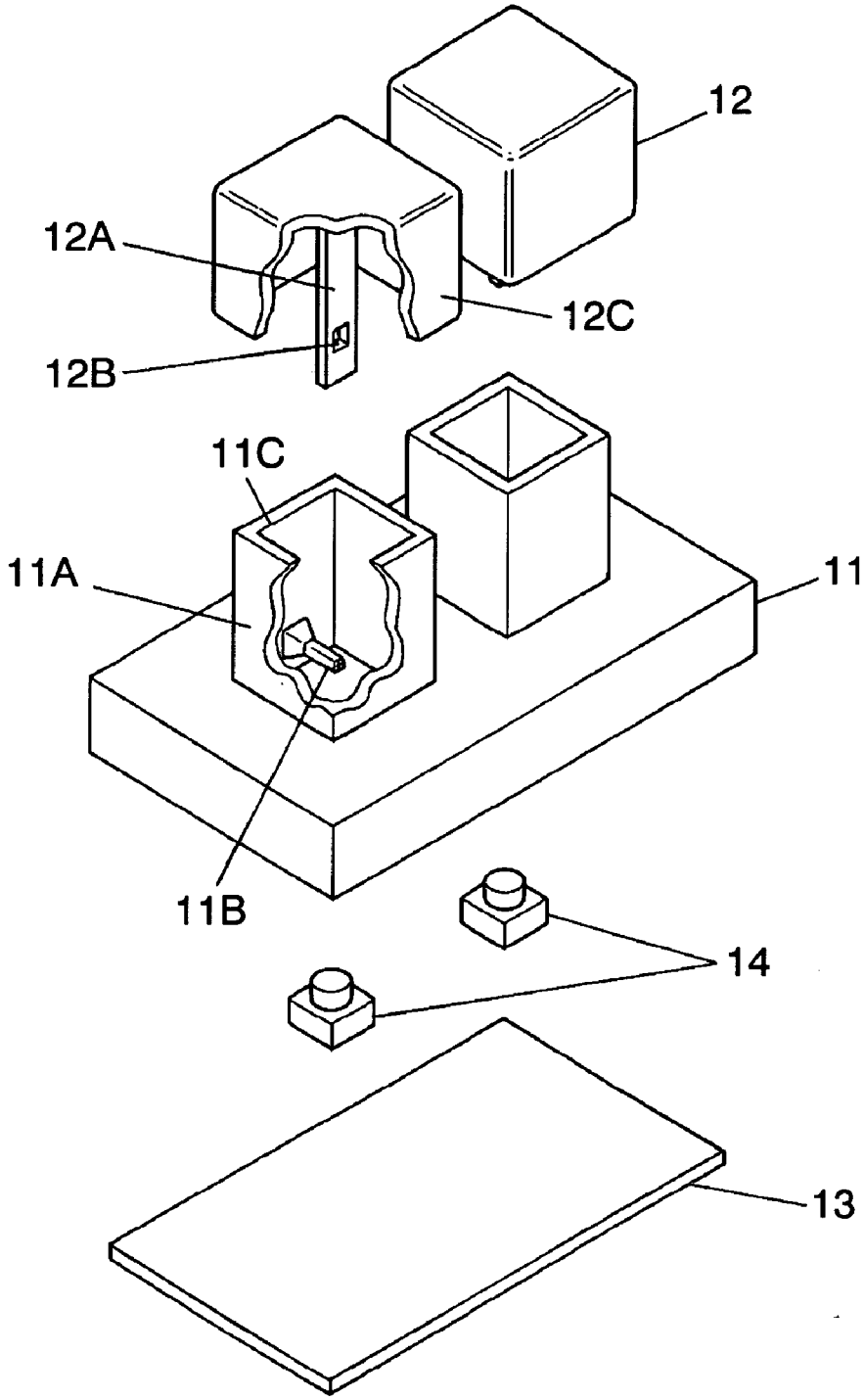
FIG. 3 is an exploded perspective view of the switch apparatus of FIG. 1.

FIG. 1 is a sectional view of a switch apparatus in an embodiment of the present invention. FIG. 2 is a sectional view in a direction orthogonal to that of FIG. 1. FIG. 3 is an exploded perspective view of the switch apparatus. Case 11 is made of an insulating resin such as acrylonitrile-butadiene-styrene (ABS) and polyacetal, and buttons 12 are made of an insulating resin such as ABS and polycarbonate. Hollow cylindrical support sections 11A that project upward are provided on case 11, and catch section 11B that projects inwardly is provided on the inner surface of support sections 11A. That is, catch section 11B projects from the inner surface of support section 11A.

Depressing section 12A that project downwardly is provided on the rear surface of button 12 and engaging hole 12B is provided on depressing section 12A. That is, button 12 is mounted in a manner such that depressing section 12A projects into the interior of support section 11A in parallel to the direction of projecting of support section 11A. Catch section 11B is inserted into engaging hole 12B and button 12 is mounted on support section 11A in a manner vertically movable. That is, button 12 is movable in the direction of projecting of support section 11A. Wiring board 13 is made of such material as paper-impregnated phenolic resin, glass-impregnated epoxy, and conductive patterns (not drawn) are formed on the top and bottom surfaces. Also, push switches 14 are mounted on the top surface, thus forming a switch contact.

Bottom end of depressing section 12A on the rear surface of button 12 comes into contact with push switch 14. A switch apparatus is configured by covering push switch 14 and top surface of wiring board 13 with case 11.

When fabricating case 11 and button 12 that compose a switch apparatus as configured above with respective upper die and lower die, catch section 11B can be easily formed with the upper and the lower dies for case 11. Also, engaging hole 12B is formed by moving a slide pin back and forth inside the die for molding button 12. Accordingly, fabrication is possible even when the spacing between adjacent support sections 11A that project upwardly of case 11 is small. Also, as no opening is formed due to piercing of a pin during the molding process, the top surface of case 11 is maintained to be sealed.

Figure 4:
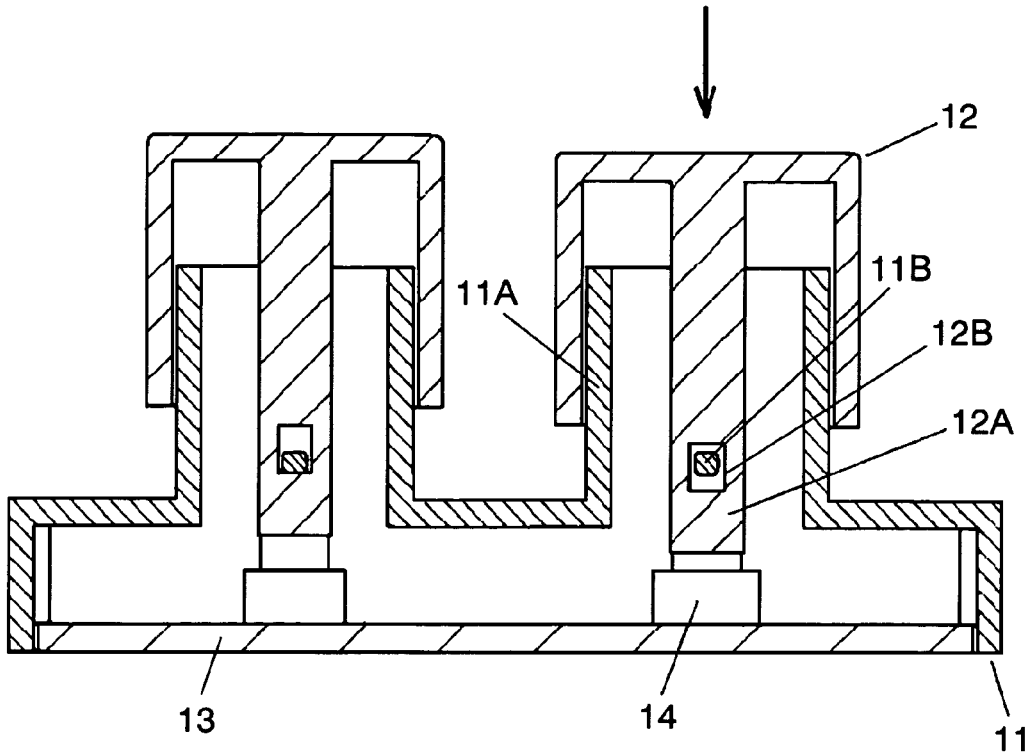
FIG. 4 is a sectional view of the switch apparatus of FIG. 1 while being operated.
Figure 5:
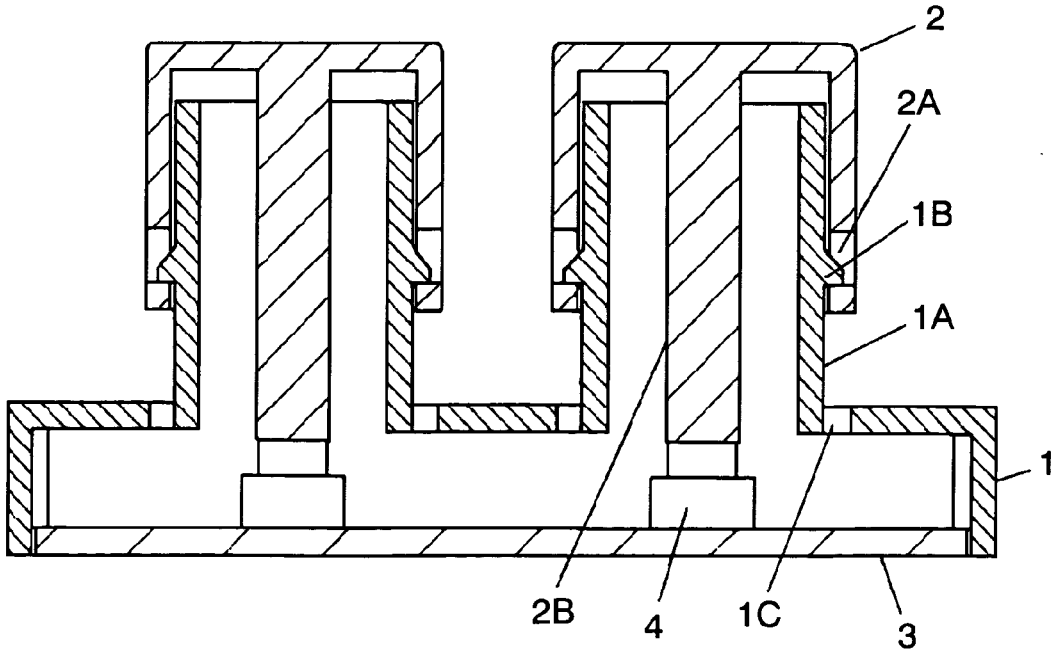
FIG. 5 PRIOR ART
FIG. 5 is a sectional view of a conventional switch apparatus.
Figure 6:
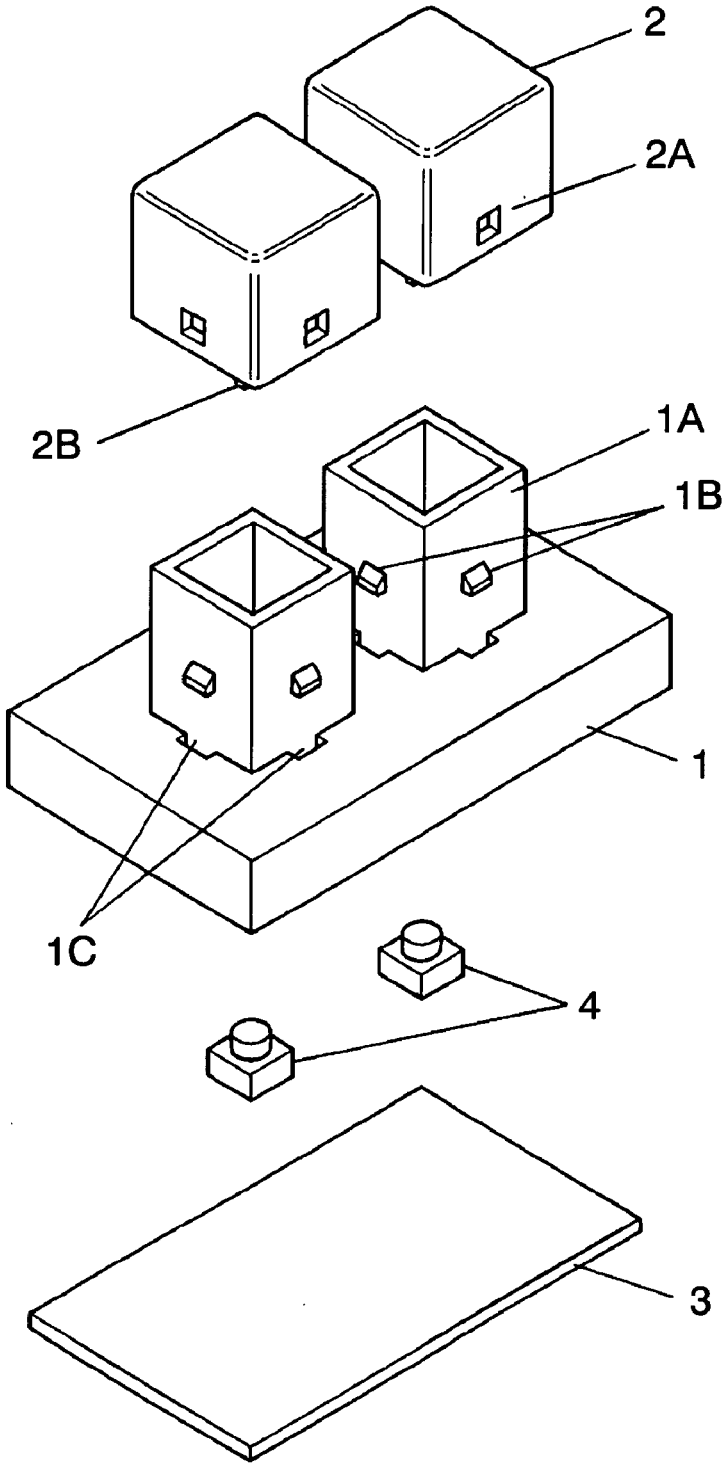
FIG. 6 PRIOR ART
FIG. 6 is an exploded perspective view of the switch apparatus of FIG. 5.
Figure 7:
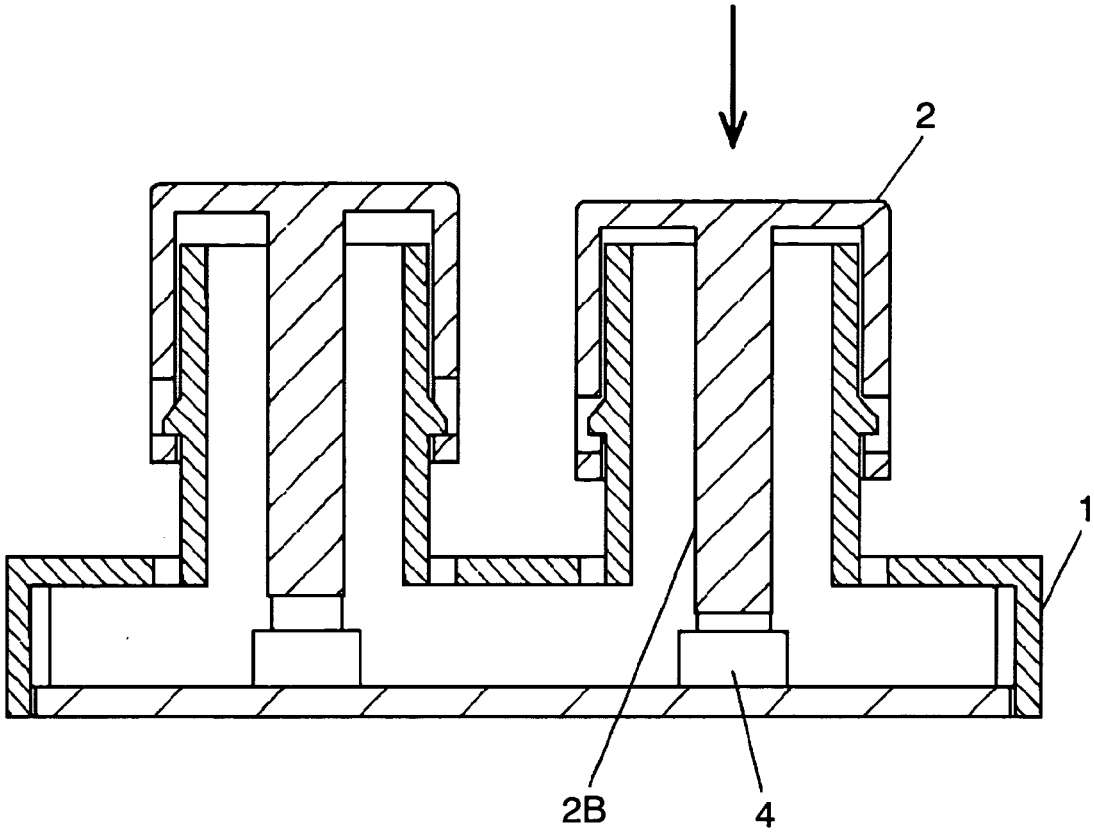
FIG. 7 PRIOR ART
FIG. 7 is a sectional view of the switch apparatus of FIG. 5 while being operated.

A brief description of this switch apparatus is given. When button 12 on the right, for example, is depressed as shown in FIG. 4, button 12 moves downward, and depressing section 12A on the rear surface depresses push switch 14 on the right thus performing electrical on-off action inside switch 14. When depressing force on button 12 is released, button 12 returns to the state of FIG. 1 by the returning force of push switch 14.

In the switch apparatus of this embodiment, catch section 11B is provided on the inner periphery of support section 11A of case 11 in a manner projecting toward the inside as described above. And, engaging hole 12B into which catch section 11B is to be inserted is provided on depressing section 12A on the rear surface of button 12 which is mounted on support section 11A in a manner vertically movable. By configuring the switch apparatus in this way, button 12 engages inside support section 11A of case 11. When manufacturing such a switch apparatus, it is not necessary to provide an opening on the top surface of case 11. That is, the portions other than support section 11A of the top surface of case 11 are closed. As a result, a switch apparatus can be obtained which is superior in resistance to water and dust and is stable in operation.

In the above description, switch contacts are formed by mounting push switches 14 on the top surface of wiring board 13. The present invention can be embodied in various switch contact configurations in addition to push switch 14. For example, a fixed contact may be formed with carbon and the like on the top surface of wiring board 13 followed by laying dome-shaped movable contact made of thin sheet of copper alloy on the fixed contact. Also, the configuration may be such that an upper sheet and a lower sheet respectively having a movable contact and a fixed contact are facing each other.

In FIG. 1 to FIG. 3, button 12 has side section 12C in a manner covering support section 11A. With this arrangement, water and dust are prevented from entering into the switch apparatus. In addition to this arrangement, the switch apparatus may be configured such that button 12 fits inside of opening 11C of support section 11A. In this case, it is necessary to make the clearance between button 12 and opening 11C small in order to prevent water and dust from entering into the switch apparatus. It is also necessary to design the dimensions so that side section 12C and catch section 11B will not come into contact with each other when operating button 12.

Also, although support section 11A and side section 12C of button 12 are shown to have a rectangular cross section, the cross section may be circular. However, a polygonal shape such as a rectangle is preferable from the stand point of preventing rotation of button 12.

As described above, the switch apparatus according to the present invention is superior in resistance to water and dust, stable in operation, and useful as a switch apparatus for operating air conditioners and audio equipment for automobiles.

What is claimed is:

1. A switch apparatus including:

A) a case having

A-1) a projecting hollow cylindrical support section; and

A-2) a catch section provided in a manner projecting from inner surface of the support section;

B) a button having a depressing section provided inside the support section in parallel to the direction of projecting of the support section in a manner projecting from an inner surface of the support section, the depressing section provided with an engaging hole into which the catch section is to be inserted, and the button mounted in a manner movable in the direction of projecting of the support section; and C) a switch contact provided inside the case for performing electrical on-off action upon being depressed by the depressing section.

2. The switch apparatus of claim 1, wherein the button further has a side section for covering the support section.

3. The switch apparatus of claim 2, wherein configuration of the cross sections of the side section and the support section is polygonal.

4. The switch apparatus of claim 1, wherein the portions of the surface of the case other than the portion where the support section is formed are closed.

* * * * *